US005988946A

United States Patent [19]

Reed

[11] Patent Number: 5,988,946

[45] Date of Patent: Nov. 23, 1999

[54] MULTIPLE BLADDER FLOOD CONTROL SYSTEM

[76] Inventor: Charles Reed, 340 N. Oakhurst, Beverly Hills, Calif. 90210

[21] Appl. No.: 09/085,351

[22] Filed: May 27, 1998

[51] Int. Cl.[6] ..... E02B 7/02

[52] U.S. Cl. ..... 405/115; 405/91; 405/114

[58] Field of Search ..... 405/91, 114, 115

[56] References Cited

U.S. PATENT DOCUMENTS

| | | | |
|---|---|---|---|
| 2,855,800 | 12/1958 | Ganzinotti | 405/91 |
| 3,191,386 | 6/1965 | Wiegel | 61/5 |
| 3,786,638 | 1/1974 | Fish | 405/115 |
| 3,928,980 | 12/1975 | Ganzinotti | 61/29 |
| 4,279,540 | 7/1981 | Suga et al. | 405/115 |
| 4,299,514 | 11/1981 | Muramatsu et al. | 405/115 |
| 4,314,774 | 2/1982 | Tsuji et al. | 405/115 |
| 4,662,783 | 5/1987 | Muramatsu et al. | 405/115 |
| 4,733,990 | 3/1988 | Tsuji et al. | 405/115 |
| 4,780,024 | 10/1988 | Obermeyer et al. | 405/115 |
| 4,836,713 | 6/1989 | Muramatsu et al. | 405/115 |
| 4,909,666 | 3/1990 | Takasaki | 405/115 |
| 5,067,851 | 11/1991 | Fujisawa et al. | 405/115 |
| 5,125,767 | 6/1992 | Dooleage | 405/115 |
| 5,645,373 | 7/1997 | Jenkins | 405/91 |
| 5,785,455 | 7/1998 | Eaker | 405/63 |

FOREIGN PATENT DOCUMENTS

| | | | |
|---|---|---|---|
| 678133 | 8/1979 | U.S.S.R. | 405/115 |

*Primary Examiner*—David Bagnell
*Assistant Examiner*—Jong-Suk Lee
*Attorney, Agent, or Firm*—Goldstein & Canino

[57] ABSTRACT

A multiple bladder flood control system, for preventing flood waters from reaching a protected area from a flooding area, comprising a bladder assembly. A trough is dug between the protected area and the flooding area, having a trough bottom, a trough first side, and a trough second side which are all preferably surfaced with concrete. The trough first side faces the protected area, and the trough second side faces the flooding area. The bladder assembly is anchored to the trough bottom with an anchor plate. The bladder assembly comprises at least a lowermost bladder and at least one upper bladder. The bladders are attached with a common connecting surface which faces the flooding area. The bladder assembly is normally deflated, is stored fully within the trough, and the trough is covered with a cover plate. When flood waters are advancing, the cover plate is removed and the bladder assembly is inflated. The lowermost bladder remains in the trough and is pressed against the first wall by water entering at the second wall. The upper bladders extend above the trough to prevent the flood waters from reaching the protected area.

10 Claims, 6 Drawing Sheets

MULTIPLE BLADDER FLOOD CONTROL SYSTEM

BACKGROUND OF THE INVENTION

The invention relates to a multiple bladder flood control system. More particularly, the invention relates to a flood control system which employs a plurality of vertically stacked bladders, which are normally stored in a subterranean trough, but which are selectively inflatable during a flooding condition to create a barrier to stop advancing flood waters.

Events of recent years have shown just how devastating flooding can be. Although flooding is somewhat expected in coastal regions, these recent events have shown that even those living in desert regions are susceptible to flooding.

Once the water starts rising, there is little that a resident can do to stop the waters from destroying his home.

Probably one of the oldest attempted solutions is to create a wall of sandbags around the property, or adjacent to an overflowing river. Sandbags seek to block rising water by presenting a heavy barrier for the water. However, an effective sand bag barrier requires two things—a lot of sand, and a lot of people to fill the bags and hoist them into place. Thus, an individual homeowner will typically lack the materials and stamina necessary to complete the sandbag wall building task.

In lieu of sandbagging, several devices have been proposed at an attempt at creating different types of inflatable barriers. However, these devices typically fail, since their configuration and anchoring makes them unsuitable for combating the forces inherent in surging flood waters.

While these units may be suitable for the particular purpose employed, or for general use, they would not be as suitable for the purposes of the present invention as disclosed hereafter.

SUMMARY OF THE INVENTION

It is an object of the invention to produce a multiple bladder flood control system which is selectively deployable to effectively block advancing flood waters from reaching a protected area. Accordingly, a barrier is created which is impenetrable to flood waters.

It is another object of the invention to produce a multiple bladder flood control system which is normally non-obtrusive to the landscaping surrounding the protected area, but which can be quickly and easily deployed when needed. Accordingly, the bladders may be installed in a subterranean trough, and are covered with a cover plate. Preparation for deployment of the invention involves simply removing the cover plate. Actual deployment of the invention involves simply filling the bladders with compressed air until the bladders are fully inflated.

It is yet another object of the invention to produce a multiple bladder flood control system which is capable of withstanding the force of rising flood waters. Accordingly, a lowermost bladder is located in the trough, so that the horizontal forces of the water are exerted against a virtually immovable object—the ground itself.

It is a further object of the invention that the invention is configured to be equipped differently at installations having varying expected flood heights, according to the region where it is located. Accordingly, the bladders are arranged vertically, so that by varying the number of bladders, the invention can be configured to effective block flood waters for a height which is suitable for the locale where it is installed.

The invention is a multiple bladder flood control system, for preventing flood waters from reaching a protected area from a flooding area, comprising a bladder assembly. A trough is dug between the protected area and the flooding area, having a trough bottom, a trough first side, and a trough second side which are all preferably surfaced with concrete. The trough first side faces the protected area, and the trough second side faces the flooding area. The bladder assembly is anchored to the trough bottom with an anchor plate. The bladder assembly comprises at least a lowermost bladder and at least one upper bladder. The bladders are attached with a common connecting surface which faces the flooding area. The bladder assembly is normally deflated, is stored fully within the trough, and the trough is covered with a cover plate. When flood waters are advancing, the cover plate is removed and the bladder assembly is inflated. The lowermost bladder remains in the trough and is pressed against the first wall by water entering at the second wall. The upper bladders extend above the trough to prevent the flood waters from reaching the protected area.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
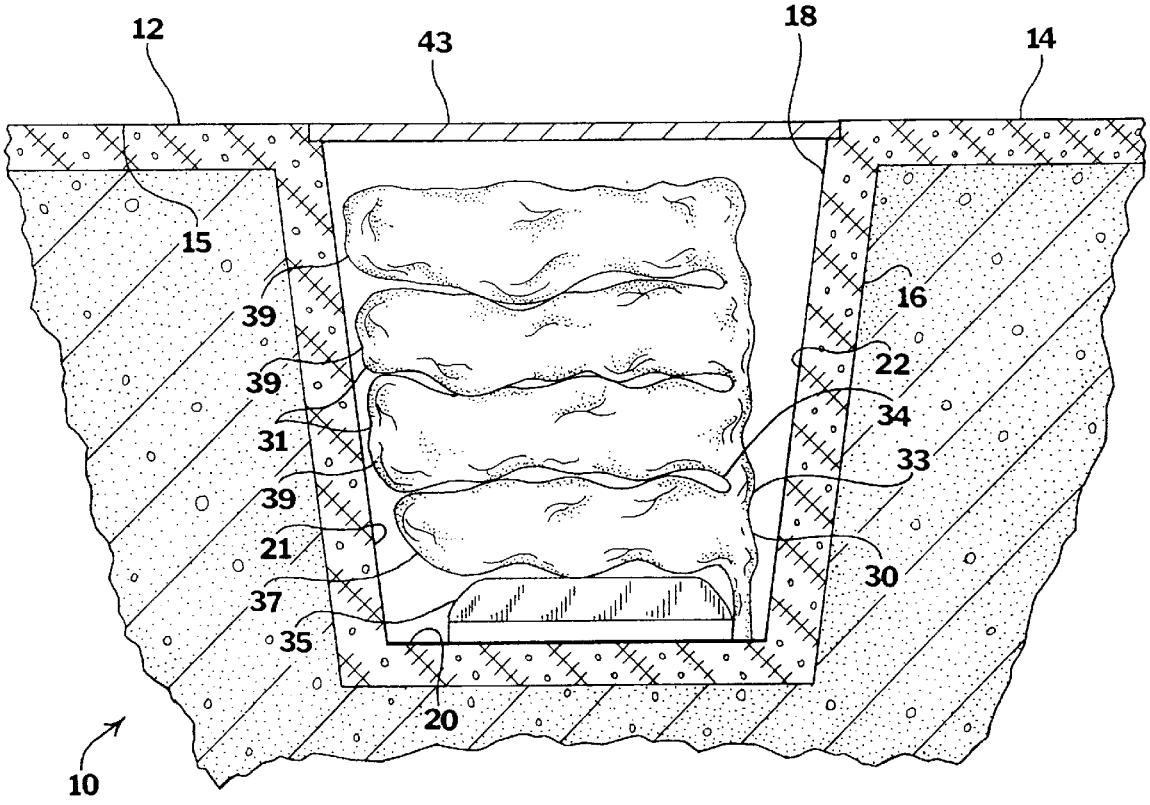
FIG. 1 is a side elevational view, illustrating the invention, fully deflated in the storage position.

FIG. 1 illustrates a flood control system 10, for preventing flooding to a protected area 12, from traveling from a flooding area 14. The protected area 12 and flooding area 14 generally comprising a common ground surface 15. A trough 16 is constructed to border the protected area 12. The trough 16 is preferably surfaced with a layer of concrete 18. The trough 16 has a bottom surface 20, a first side wall 21 and a second side wall 22. The bottom surface 20 is below the ground surface 15.

A bladder assembly 30 comprises a plurality of bladders 31, connected with a common connecting surface 33. The bladders 31 are connected to vertically adjacent bladders at a joining point 34 at the common connecting surface 33. The bladders 31 are otherwise unattached to each other. The common connecting surface 33 extends vertically The connecting surface extends facing the flooding area 14. The bladder assembly 30 is anchored to the bottom surface 20 with an anchoring plate 35. Preferably the common connecting surface 33 is anchored with the anchoring plate 35.

The bladders 31 are stacked vertically, including a lowermost bladder 37, and upper bladders 39. In FIG. 1, the bladder assembly 30 is fully deflated, in a storage position. The entire bladder assembly 30 is beneath the ground surface 15. A cover plate 43 extends over the trough 16 between the protected area 12 and the flooding area 14.

Figure 2:
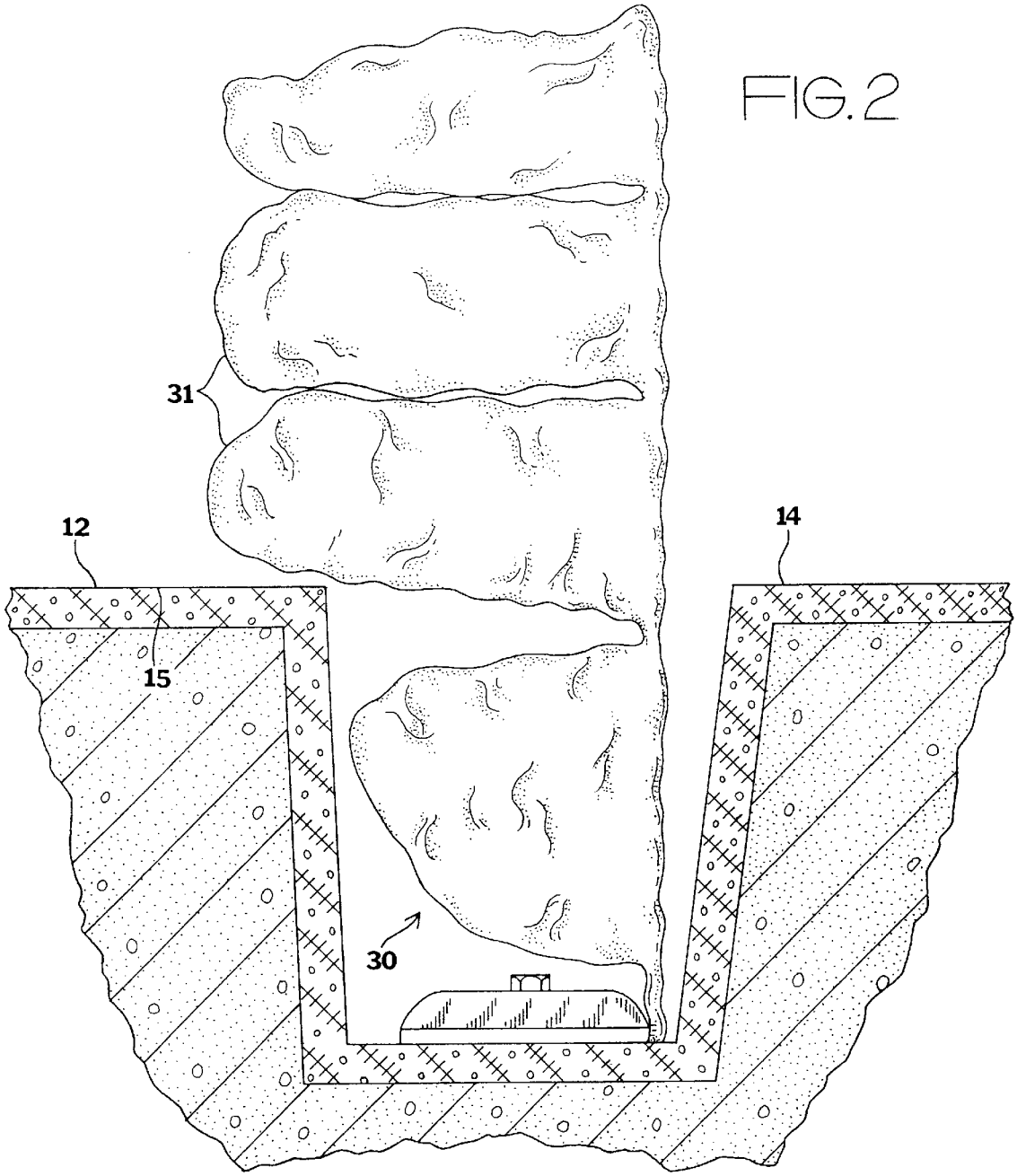
FIG. 2 is a side elevational view, illustrating the invention being deployed, wherein the bladders are partially inflated.

In FIG. 2, the flood control system 10 is being deployed, wherein compressed air is introduced into the bladder assembly 30 to inflate the bladders 31. The bladders 31 are all in a state of partial inflation. As the bladders 31 inflate, they rise upward, to being to create a wall between the flooding area 14 and the protected area 12 that extends above the ground surface 15.

Figure 3:
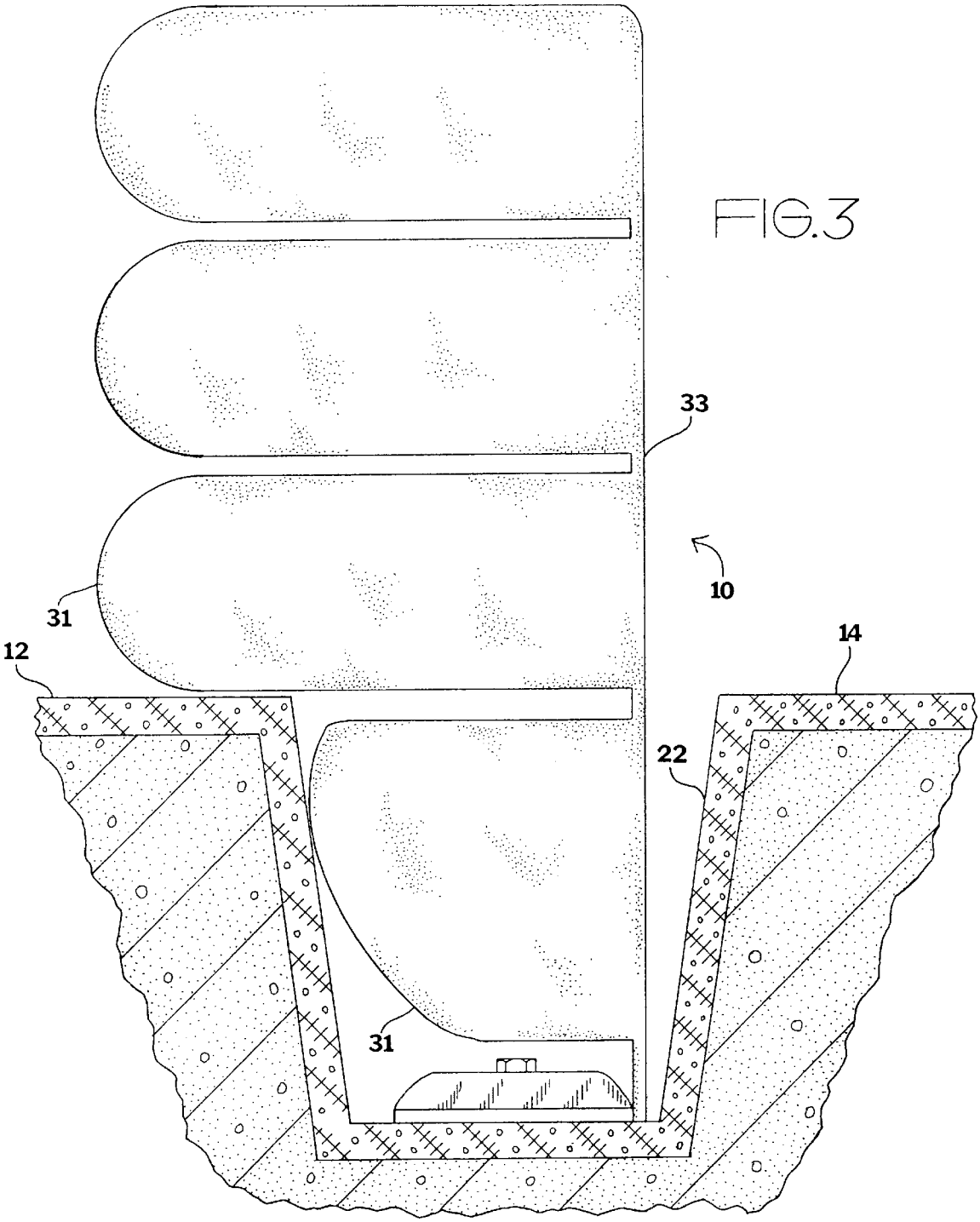
FIG. 3 is a side elevational view, illustrating the invention fully deployed, wherein the bladders are fully inflated.
Figure 4:
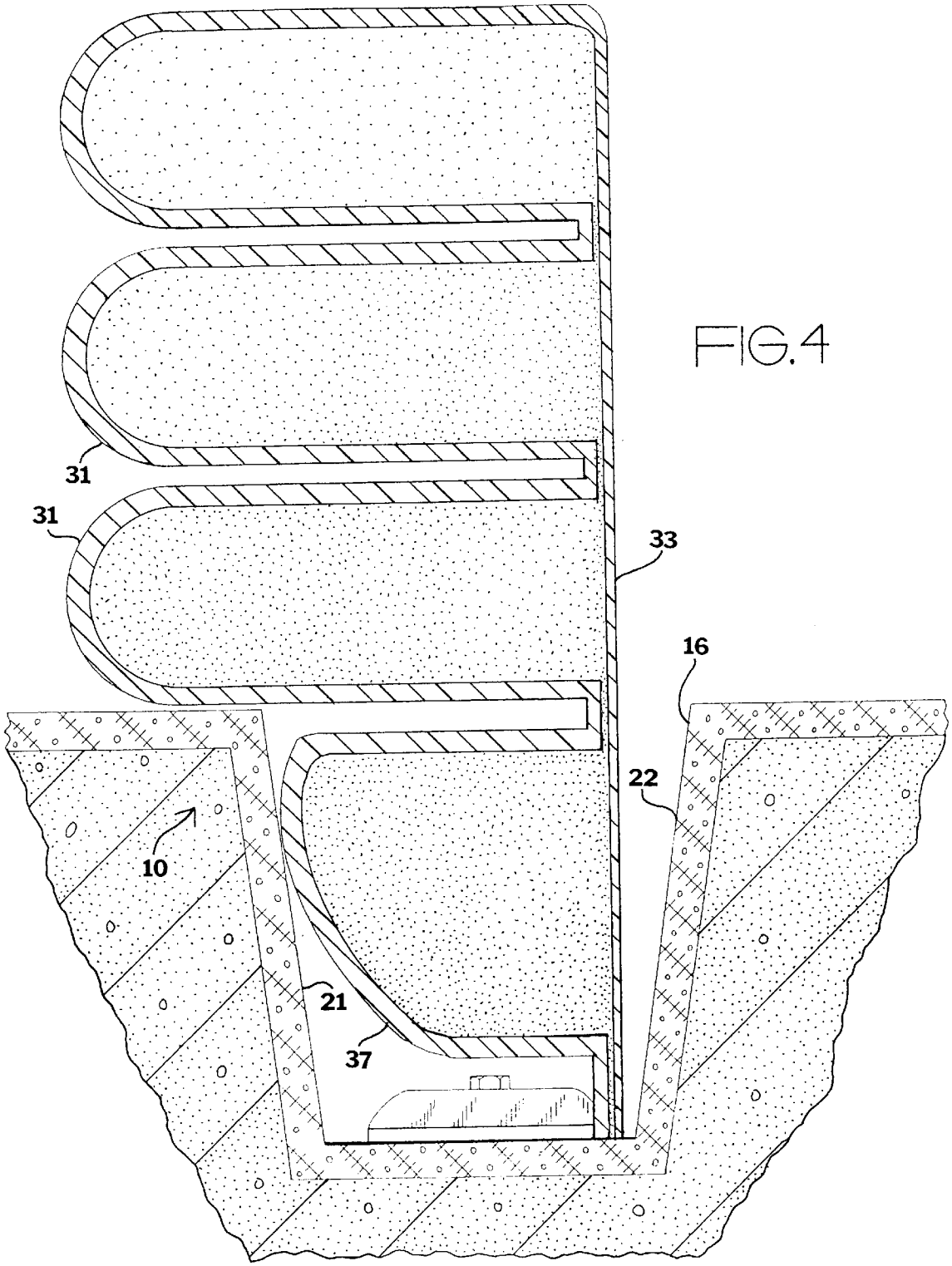
FIG. 4 is a cross sectional view, illustrating the invention fully deployed.

In FIG. 3 and FIG. 4, the flood control system 10 is fully deployed, wherein the bladders 31 are all fully inflated. A wall has thus been created to prevent water from reaching the protected area 12. The common connecting surface 33 is extending substantially vertically, and faces the flooding area 14.

Once fully deployed, the lowermost bladder 37 extends in the trough 16, such that it is in contact with the first side 21, which is adjacent to the protected area 12. Further, a space is present between the common connecting surface 33 and the second side 22, which is adjacent to the flooding area.

Figure 5:
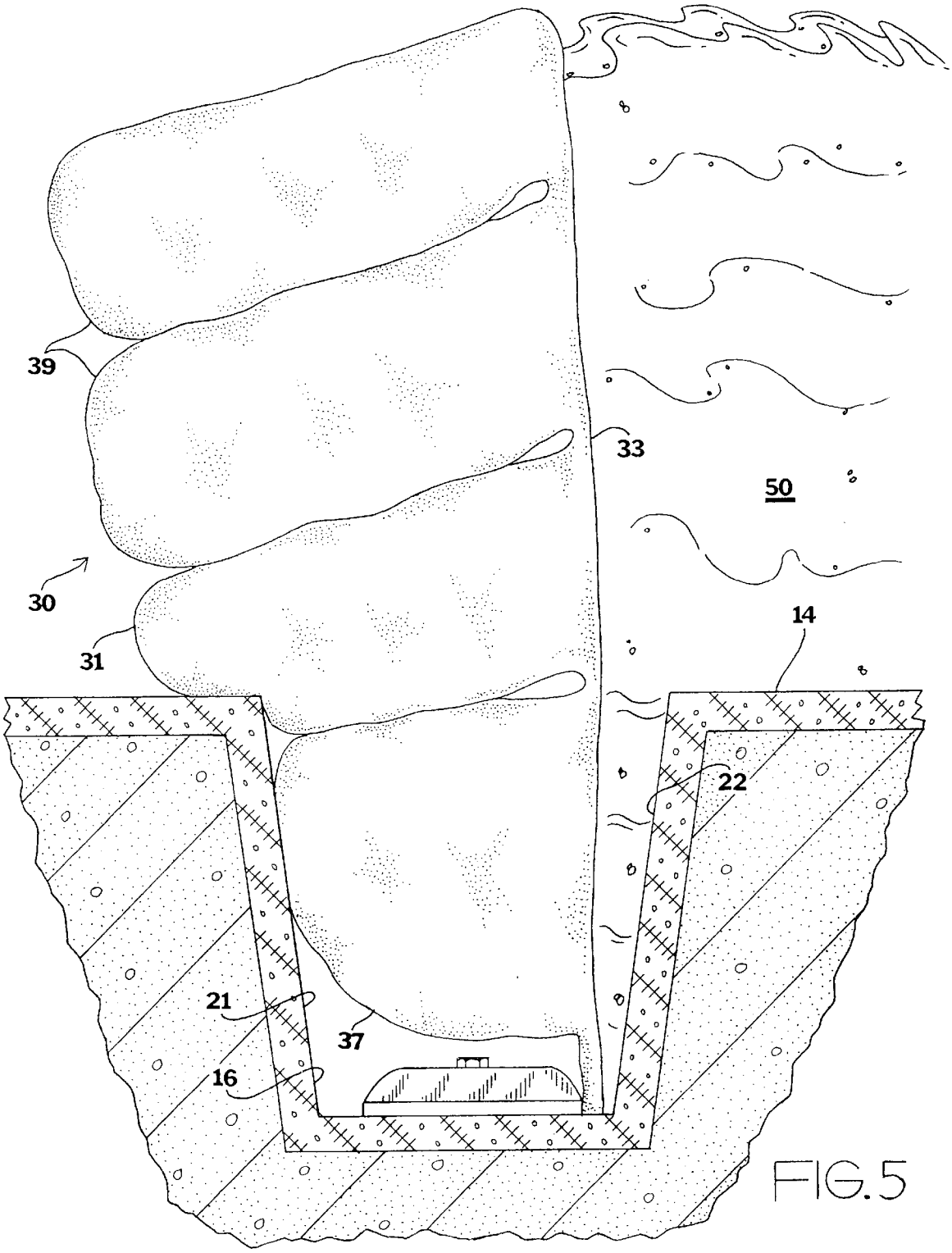
FIG. 5 is a side elevational view of the invention in use, wherein flood waters have risen in the flooding area, and the invention is preventing the flood waters from reaching the protected area.

Referring to FIG. 5, once flood waters 50 enter the trough at the second side, they push the lowermost bladder 37 against the first side 21. The water in the trough 16 will be the deepest, and thus will exert the greatest static pressure against the lowermost bladder 37. Thus, the bladder assembly 30 is essentially anchored against the first side 21 by the water pressure. As pressure from the flood waters 50 increase on the common connecting surface 33, the uppermost bladders 39 will be pushed toward the protected area, compressing the bladders 31 vertically against each other.

The greatest stresses on the flood control system 10 are on the common connecting surface 33, and thus on the anchoring plate 35. The common connecting surface 33 must be made of a material which has a great tensile strength, because the tendency is for the uppermost bladders to tear free of the lowermost bladder, and for the lowermost bladder 37 to tear free of the anchoring plate 35. Once pressure builds from the flooding area 14 upon the common connecting surface 33, the bladders themselves will compress downward against each other.

Figure 6:
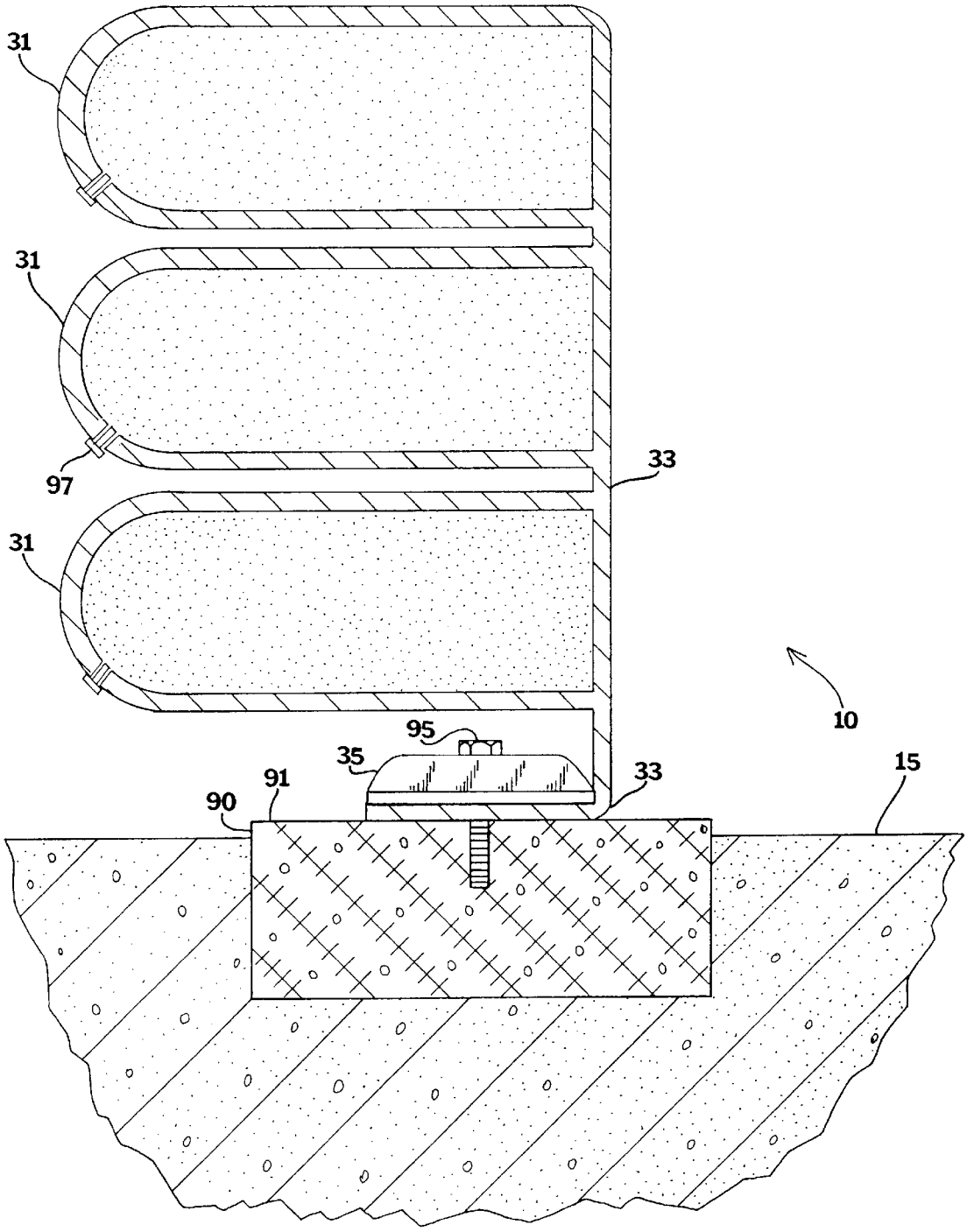
FIG. 6 is a cross sectional view, illustrating a further embodiment of the invention, in which the bladders are mounted directly to a concrete block, and wherein each bladder is self contained, having its own valve.

FIG. 6 illustrates a further embodiment of the flood control system 10, in which said system extends above the ground surface 15, wherein the trough has been eliminated. A concrete anchoring block 90 extends into the ground, and has a top surface 91 which is exposed through the ground surface 15. The common connecting surface 33 is connected to the anchoring block 90 with the anchoring plate 35. The anchoring plate 35 is secured to the concrete block 90 with a anchoring bolt 95. The anchoring block 90 should be sufficiently heavy and well situated in the ground so that it can resist the tendency to be pulled from the ground as force from the advancing flood waters increases upon the common connecting surface 33.

Also illustrated in FIG. 6, the bladders 31 are each self contained, and separately sealed. Each bladder 31 has a valve 97 for allowing inflation of that bladder. According to this embodiment, a puncture to one of the bladders 31 will not cause all bladders 31 to deflate. Having separately sealed bladders 31 provides a redundancy which is especially important when debris is floating within flood waters.

In conclusion, herein is presented a flood control system which comprises a series of vertically arranged bladders which are normally deflated and may be anchored within a subterranean trough which is located between a protected area and a flooding area. When flood waters approach from the flooding area, the bladders are inflated to rise above the trough and prevent a wall which prevents the flood waters from reaching the protected area.

What is claimed is:

1. A multiple bladder flood control system, for use in preventing flood water from advancing from a flooding area to a protected area, the protected area and flooding area having a common ground surface, comprising:

a trough that extends into the ground surface, beneath the ground surface, the trough having a trough bottom, a trough first side and a trough second side, the trough first side adjacent to the protected area, the trough second side adjacent to the flooding area;

a bladder assembly located within the trough which is normally fully below the ground surface, but which selectively inflatable to create a wall extending above the ground surface.

2. The multiple bladder flood control system as recited in claim 1, wherein the bladder assembly further comprises at least two bladders that are vertically stacked, the bladders are attached with a common connecting surface that faces the flooding area.

3. The multiple bladder flood control system as recited in claim 2, wherein the at least two bladders comprise a lowermost bladder, when the lowermost bladder is fully inflated the lowermost bladder remains below the ground surface so that when flood water enters the trough at the trough second side the flood water presses the lowermost bladder against the trough first side.

4. The multiple bladder flood control system as recited in claim 3, wherein the common connecting surface is anchored to the trough bottom with an anchor plate.

5. The multiple bladder flood control system as recited in claim 4, wherein the trough is surfaced with concrete.

6. The multiple bladder flood control system as recited in claim 5, further comprising a cover plate which normally covers the trough, but is selectively removable prior to inflation of the bladder assembly.

7. A multiple bladder flood control method, using a bladder assembly comprising a lowermost bladder and at least one upper bladder, for preventing flood water from reaching from a protected area to a flooding area, comprising:

digging a trough having a trough bottom, a trough first side, and a trough second side, between the flooding area and the protected area;

anchoring the bladder assembly to the trough bottom; and inflating the bladder assembly upon the presence of advancing flood water so that the upper bladder extends above the trough to create a wall to prevent the flood water from reaching the protected area.

8. The multiple bladder flood control method as recited in claim 7, wherein during the step of inflating the bladder, the lowermost bladder remains within the trough, and when the flood water enters the trough at the trough second side the flood water presses the lowermost bladder against the trough first side.

9. The multiple bladder flood control method as recited in claim 8, wherein the bladders are attached by a common connecting surface, and wherein the step of inflating the bladder further comprises:

extending the common connecting surface vertically so that the common connecting surface faces the flooding area.

10. The multiple bladder flood control method as recited in claim 9, wherein the flooding area and the protected area exist at a common ground surface, and wherein the step of inflating the bladder assembly is preceded by:

covering the trough with a cover plate; and removing the cover plate upon the presence of advancing flood waters.

* * * * *